US005138226A

United States Patent [19]

Johnson

[11] Patent Number: 5,138,226

[45] Date of Patent: Aug. 11, 1992

[54] SURFACE MOUNTABLE MINIATURE INCANDESCENT LIGHT

[75] Inventor: Ralph Johnson, Los Alamitos, Calif.

[73] Assignee: Illumination Technology, Inc., Los Alamitos, Calif.

[21] Appl. No.: 655,542

[22] Filed: Feb. 13, 1991

[51] Int. Cl.[5] ..... H01J 17/18

[52] U.S. Cl. ..... 313/623; 313/318; 313/624; 313/625; 313/634

[58] Field of Search ..... 313/237, 623, 624, 625, 313/634, 318, 51, 578; 445/26, 44; 362/253, 217, 221, 226

[56] References Cited

U.S. PATENT DOCUMENTS

| | | | |
|---|---|---|---|
| 3,060,344 | 10/1962 | Scholes | 313/318 |
| 3,346,751 | 10/1967 | Lienhard | 313/237 |
| 4,537,323 | 8/1985 | Ditihek et al. | 313/625 |
| 4,713,580 | 12/1987 | Shoene | 313/624 |
| 4,952,838 | 8/1990 | Dunah | 313/318 |
| 4,970,428 | 11/1990 | Hayakawa | 313/623 |

*Primary Examiner*—Donald J. Yusko
*Assistant Examiner*—Diab Hamadi
*Attorney, Agent, or Firm*—Klein & Szekeres

[57] ABSTRACT

A miniature incandescent lamp assembly has an elongated substantially cylindrical glass envelope having a first end and a second end. A substantially cylindrical first metal end member seals the first end of the glass envelope with a seal of substantially cylindrical configuration where the glass of the envelope is in glass-to-metal contact with the first metal end member. A substantially cylindrical second metal end member seals the second end of the glass envelope with another seal of substantially cylindrical configuration. In this seal also, the glass of the envelope is in glass-to-metal contact with the second metal end member. An incandescent filament is disposed between the first and second metal end members within the interior of the glass envelope in electrical contact with the first and second metal end members. Each of the first and second metal end members has a metal cap attached to the outside of the glass envelope, with the metal caps being larger in diameter than the glass envelope. The metal caps serve as a surface mountable electric contacts for the miniature incandescent lamp.

20 Claims, 2 Drawing Sheets

SURFACE MOUNTABLE MINIATURE INCANDESCENT LIGHT

BACKGROUND OF THE INVENTION

1. Field of the Invention

The present invention is directed to a surface mountable miniature incandescent light assembly, and more particularly to a surface mountable miniature incandescent light assembly in which all seals are glass to metal seals of substantially cylindrical configuration.

2. Brief Description of the Prior Art

Miniature incandescent lights have many applications in electronic and like appliances and equipment, with digital watches serving as a primary example. It is generally recognized in the art that for economy of manufacture the miniature incandescent lights must be adapted for surface mount technology, that is the miniature incandescent lights must be capable of being incorporated in equipment (such as an electronic watch) in an electronic assembly line without the need of soldering or welding connections to a circuit board.

Miniature incandescent lights of the prior art are, however, primarily designed for mounting to circuit boards by soldering, and to this end the prior art miniature lights usually incorporate wires which extend from two ends of a light assemby of elongated shape. A prior art miniature incandescent light design of which the present inventor is aware, and which is said to be adapted for surface mount technology, has an elongated cylindrical envelope for an incandescent filament and open cylindrical metal end caps mounted to the envelope. Leads extend from the envelope through resilient pliable material to connect with the end caps.

A disadvantage of the miniature incandescent lights of the prior art, of which the present inventor is aware, that the lights contain seals where wires penetrate glass, or glass-to-metal seals which do not have a relatively extended surface area. Because miniature incandescent lights are evacuated (contain vacuum) to minimize heat loss in the filament, efficient seals are important. The present invention provides a miniature incandescent light assembly which is highly adapted for surface mount technology, and which has only glass-to-metal seals of relatively extended surface area of substantially cylindrical configuration.

SUMMARY OF THE INVENTION

It is an object of the present invention to provide a miniature incandescent light assembly which is adapted for surface mount technology.

It is another object of the present invention to provide a miniature incandescent light assembly which has a symmetrical end profile, to facilitate its use in surface mount technology.

It is still another object of the present invention to provide a miniature incandescent light assembly which does not contain silicone rubber or other filler material.

It is a further object of the present invention to provide a miniature incandescent light assembly which has no glass-to-glass seal, and contains only glass-to-metal seals of substantially cylindrical configuration.

It is still a further object of the present invention to provide a miniature incandescent light assembly which has uniform and precise end terminal alignment.

The foregoing and other objects and advantages are attained by a miniature incandescent lamp assembly which has an elongated substantially cylindrical glass envelope having a first end and a second end. A substantially cylindrical first metal end member seals the first end of the glass envelope with a seal of substantially cylindrical configuration. In the seal the glass of the envelope is in glass-to-metal contact with the first metal end member. A substantially cylindrical second metal end member seals the second end of the glass envelope with another seal of substantially cylindrical configuration. In this seal also, the glass of the envelope is in glass-to-metal contact with the second metal end member. An incandescent filament is disposed between the first and second metal end members within the interior of the glass envelope in electrical contact with the first and second metal end members. Each of the first and second metal end members has a metal cap attached to the outside of the glass envelope, with the metal caps being larger in diameter than the glass envelope, The metal caps serve as a surface mountable electric contacts for the miniature incandescent lamp.

The features of the present invention can be best understood together with further objects and advantages by reference to the following description, taken in connection with the accompanying drawings, wherein like numerals indicate like parts.

DESCRIPTION OF THE PREFERRED EMBODIMENTS

Figure 1:
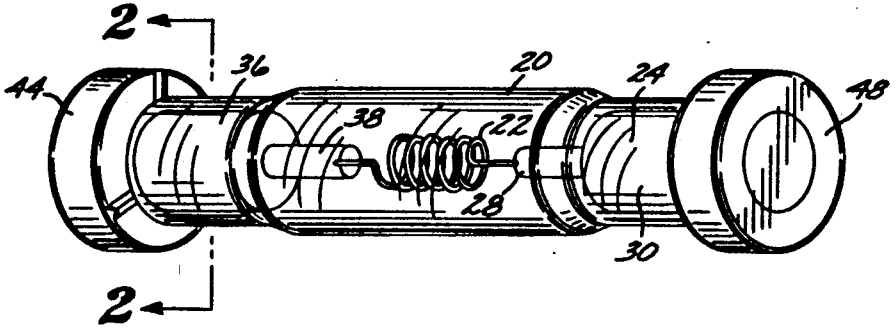
FIG. 1 is a perspective view of a first preferred embodiment of the miniature incandescent light assembly of the present invention.
Figure 2:
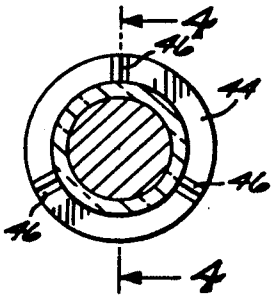
FIG. 2 is a cross-sectional view taken on lines 2,2 of FIG. 1.

The following specification taken in conjunction with the drawings sets forth the preferred embodiments of the present invention. The embodiments of the invention disclosed herein are the best modes contemplated by the inventor for carrying out his invention, although it should be understood that various modifications can be accomplished within the parameters of the present invention.

Referring now to FIGS. 1-4 of the appended drawings, the first preferred embodiment of the present invention is disclosed. A miniature incandescent lamp assembly in accordance with the present invention includes a substantially cylindrical glass envelope 20. The glass envelope 20 itself is conventional and typically comprises GO120 (soda-lead) glass, which is commercially available in the United States. A typical diameter of the glass envelope 20 which is used in the present invention is approximately 0.045 inch, and a typical length is approximately 0.200 inch. The glass envelope 20 utilized in the preferred embodiments of the present invention is purchased already cut by the manufacturer to the desired length of approximately 0.200 inch.

An incandescent filament 22 (which per se is well known in the art) is disposed substantially in the middle of the glass envelope 20, aligned substantially axially with the centerline of the envelope 20. A filament 22 which is typically used in the lamp assembly of the present invention comprises tungsten-rhenium alloy, and typically has a helical length of approximately 0.025 inch. Actual length of the wire which forms the helical coil of the filament 22 is approximately 0.200 inch. The just-described incandescent filament 22 used in the preferred embodiments of the present invention, is commercially available.

The filament 22 is disposed in the glass envelope 20 by being held in electrical contact with metal end members which seal the glass envelope 20. More specifically, a first metal end member or end piece 24 (shown on the right side of FIGS. 1, 3 and 4) has a substantially cylindrical body 26 and a leg piece 28. The cylindrical body 26 is also referred to as the "slug" 26. The slug 26 is dimensioned to fit within the glass envelope 20 and to provide together with the glass envelope 20, a glass-to-metal seal 30 of a relatively large area and of substantially cylindrical configuration. The slug 26 also has a portion 32 which extends axially outward from the glass envelope 20. This is best shown on FIG. 4. The slug 26 can be made from several metal compositions or alloys which are normally used in the art for similar purposes. A suitable metal composition which is used in the preferred embodiments of the invention for the slug 26 has a nickel-iron core covered by a copper sheath (not shown). Such a metal composition or alloy is available commercially under the DUMETR tradename. Another suitable alloy for the slug 26 is Nickel 42 alloy, which is also available commercially in the United States. An important requirement with regard to the alloy which forms the slug 26 is that the alloy must have substantially the same thermal expansion as the glass envelope 20. The slug 26 of the first preferred embodiment of the present invention is approximately 0.100 inch long. The glass-to-metal seal 30 is attained, as is well known in the art, by heating the glass envelope 20 containing the slug 26 to in a temperature range of 625°-700° centigrade while the glass envelope is evacuated.

The leg piece 28, which is concentrically attached by butt welding to the slug 26, is made from nickel. The leg piece 28 is in concentric axial alignment with the slug 26. Nickel is used for the leg piece 28 because nickel is a poorer conductor than copper. As it will be readily appreciated by those skilled in the art, in a miniature incandescent lamp of the type used in the present invention it is desirable to minimize loss of heat from the energized filament 22. For this reason, the miniature lamp of the invention (as well as minature incandescent lamps of the prior art) are evacuated to "contain vacuum, rather than being filled with an inert gas (like incandescent lamps of usual size). A butt weld attaching the leg piece 28 to the slug 26 is schematically shown as 34 on the cross-sectional view of FIG. 4. The filament 22 is mechanically welded to the leg piece 28 of the slug 26.

Referring now to the other (left) end of the glass envelope 20, the envelope 20 is sealed by a second metal end member or end piece 36, which is also referred to as a "plug" 36. The plug 36 is typically made from the same metal composition or alloy as the slug 26. The plug 36 includes a leg piece 38 made from the same material (preferably nickel) as the leg piece 28 of the slug 26. The leg piece 38 is butt welded to the plug 36. The filament is attached to the leg piece 38 of the plug 36 by a mechanical weld.

The plug 36 has a substantially cylindrical main body 40 dimensioned to fit in the glass envelope 20 and to form a glass-to-metal seal 42. In the herein described preferred embodiment the substantially cylindrical main body 40 (of the same diameter as the internal diameter of the glass envelope 20) is approximately 0.045 inch long. A cap member 44 of the plug 36 is integrally constructed with the substantially cylindrical main body 40. The cap member 44 is also cylindrical, but of larger diameter than the glass envelope 20. In the assembled miniature incandescent light (well shown in FIGS. 1 and 4) the cap member 44 acts as a surface mountable electrical contact. Three radially disposed protrusions or ribs 46, spaced at approximately 120° from one another, are located on the surface of the cap member 44 which is adjacent to the cylindrical main body 40 of the plug 36. The purpose of the protrusions or ribs 46 is to permit evacuation of air from the interior of the glass envelope 20 after the components of the miniature light are assembled and before the glass-to-metal seal 42 of the plug 36 with glass envelope is formed by heating in vacuo.

Figure 3:
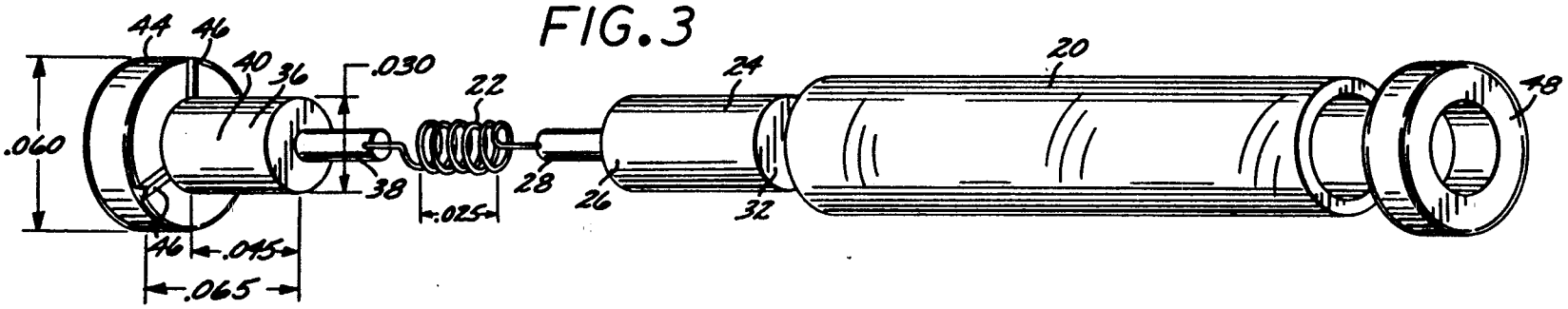
FIG. 3 is a partially exploded perspective view of the first preferred embodiment.
Figure 4:
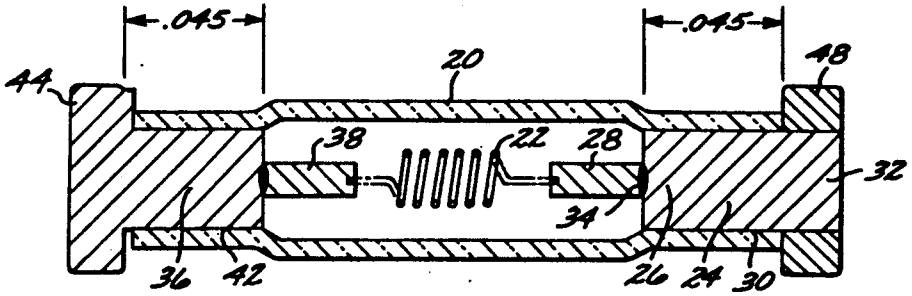
FIG. 4 is a cross-sectional view of the first preferred embodiment, the cross-section having been taken on lines 4, 4 of FIG. 2.

Referring again to the right side of FIGS. 1, 3 and 4 which depict the first preferred embodiment of the present invention, an annular cap member 48 is mounted to the extending cylindrical portion 32 of the slug 26. The annular cap member 48 is friction fitted and soldered or welded to the slug 26. The annular cap member 48 is of substantially the same diameter as the cap member 44, and serves as surface mountable contact for the miniature incandescent light of the invention. The cap member 44 is typically made from nickel, but can be made from a variety of conductive metal and alloys known in the art which can be soldered to the slug 26.

Figure 5:
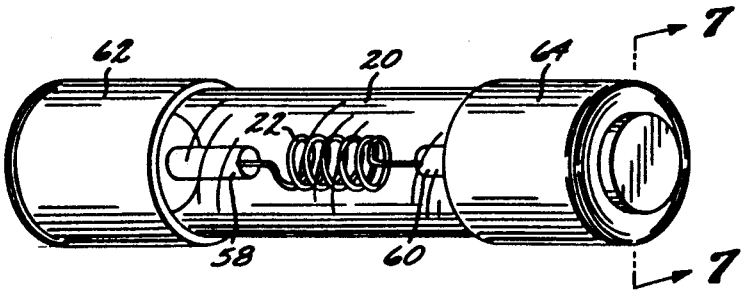
FIG. 5 is a perspective view of a second preferred embodiment of the miniature incandescent light assembly of the present invention.
Figure 6:
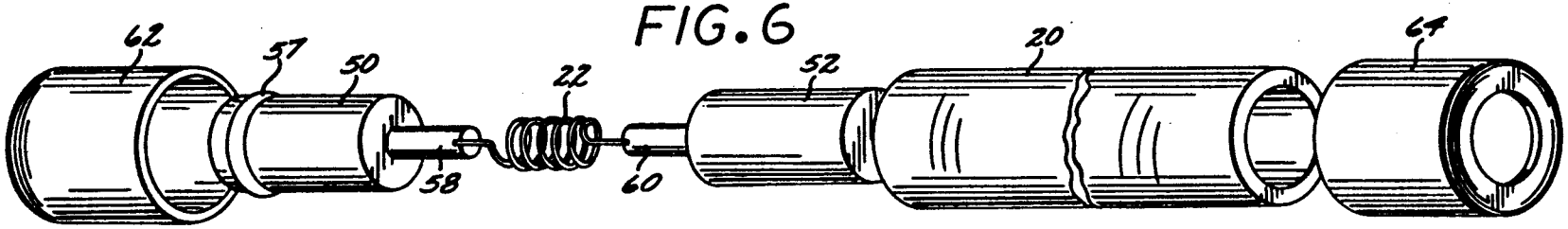
FIG. 6 is a partially exploded perspective view of the second preferred embodiment.
Figure 7:
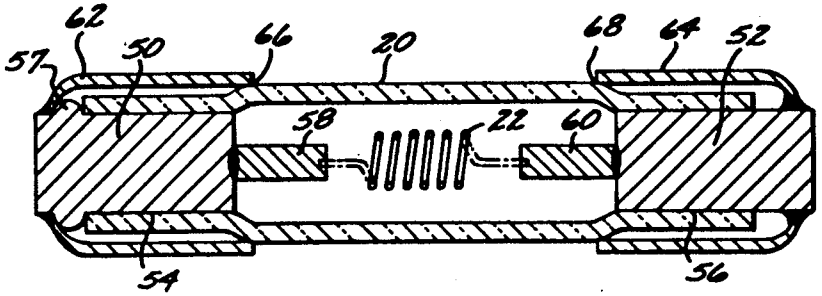
FIG. 7 is a cross-sectional view of the second preferred embodiment, taken on lines 7,7 of FIG. 5.

Referring now to FIGS. 5, 6 and 7 of the appended drawings, a second preferred embodiment of the miniature incandescent light of the present invention is disclosed. In the second preferred embodiment two metal end pieces 50 and 52 are disposed in a substantially cylindrical glass envelope 20. Each of the metal end pieces 50 and 52 is of substantially cylindrical configuration and forms a glass-to metal seal of substantial area and of substantially cylindrical configuration with the glass envelope. In the cross-sectional view of FIG. 7 the glass-to-metal seals between the end pieces 50 and 52 and the envelope 20 respectively bear the reference numerals 54 and 56. The end-piece 50 has an upset or bulge 57 which prevents this end-piece 50 from completely entering the glass envelope 20 when the unit is assembled. Each of the metal end pieces 50 and 52 include a portion which extends axially outwardly from the glass envelope 20, and include a leg piece to which the incandescent filament 22 of the miniature light bulb is attached. The leg pieces of the second preferred embodiment are labeled 58 and 60 on the drawing Figures. The several component parts of the second preferred embodiment typically comprise the same materials as the corresponding component parts of the first preferred embodiment, so that their further description is not believed to be necessary. A hollow metal cap (62 and 64 on the drawings) of substantially cylindrical symmetry is soldered or welded to the protruding portion of each end piece 50 and 52. As is shown on FIGS. 5, 6 and 7 the metal caps 62 and 64 are of larger diameter than the glass envelope 20 and act as surface mountable electrical contacts for the miniature light bulb. The cross sectional views of FIGS. 4 and 7 show the glass envelope 20 to be somewhat smaller in diameter in the areas of the glass-to-metal seals than in the center of the envelope. As this will be readily understood by those skilled in the art, the glass envelope used in the miniature light bulb of the present invention is initially of uniform diameter. However, the envelope is slightly reduced in diameter in the areas of the glass-to-metal seals during the process in which the seals are formed under heat and vacuum. Each end cap 62 and 64 makes line contact with the respective end piece 50 and 52 and the glass envelope 20 at 66 and 68. These lines of contact center the end caps 62 and 64 for ease of surface mount assembly.

Principals advantages of the miniature light bulb assembly of the present invention include their easy utilization in surface mount technology, the fact that all seals are glass-to-metal of substantially large area and of substantially symmetrical configuration, substantially symmetrical end profile, lack of wires, silicone rubber or other filler material, and the fact that the light bulb permits uniform and precise end terminal alignment in assembly.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A surface mountable miniature incandescent lamp assembly, comprising:

an elongated substantially cylindrical glass envelope having a first end and a second end;

a substantially cylindrical first metal end member which seals the first end of the glass envelope in a first air-tight seal of substantially cylindrical configuration wherein the glass of the envelope is in glass-to-metal sealing contact with the first metal end member;

a substantially cylindrical second metal end member which seals the second end of the glass envelope in a second air-tight seal of substantially cylindrical configuration wherein the glass of the envelope is in glass-to-metal sealing contact with the second metal end member;

a filament disposed between the first and second metal end members within the interior of the glass envelope and in electrical contact with the first and second metal end members;

a first metal cap larger in diameter than the glass envelope, affixed to the first metal end member and capable of serving as a surface mountable electric contact for the miniature incandescent lamp, and a second metal cap larger in diameter than the glass envelope, affixed to the second metal end member and capable of serving as a surface mountable electric contact for the miniature incandescent lamp whereby electric current flow can be established through the surface mountable electric contacts and the filament without wires and whereby the miniature lamp is sealed without the use of sealing materials.

2. The lamp assembly of claim 1 where the second metal cap is integrally constructed with the second metal end member.

3. The lamp assembly of claim 1 wherein the first metal cap is soldered to the first metal end member, and the second metal cap is soldered to the second metal end member.

4. The lamp assembly of claim 1 where the first metal cap is a substantially annular member having an opening which is friction fitted to the first metal end member.

5. The lamp assembly of claim 4 where the first annular member is soldered to the first metal end member.

6. The lamp assembly of claim 4 where the first annular member is welded to the first metal end member.

7. The lamp assembly of claim 1 further comprising a first substantially cylindrical leg member which is substantially smaller in diameter than the first metal end member, is disposed within the glass envelope, is attached to the first metal end member and is directly attached to the filament, and a second substantially cylindrical leg member which is substantially smaller in diameter than the second metal end member, is disposed within the glass envelope, is attached to the second metal end member and is directly attached to the filament.

8. The lamp assembly of claim 7 wherein the first and second leg members are concentrically disposed relative to the respective metal end member.

9. The lamp assembly of claim 7 wherein the first and second leg members are butt welded to the respective metal end member.

10. The lamp assembly of claim 7 wherein the first and second leg members consist substantially of nickel.

11. The lamp assembly of claim 7 where the first and second metal end members comprise a nickel-iron core covered by a copper sheath.

12. The lamp assembly of claim 7 where the first and second metal end members comprise nickel 42 alloy.

13. A surface mountable miniature incandescent lamp assembly, comprising:

a substantially cylindrical glass envelope having a first end and a second end;

a first metal end piece which is of substantially cylindrical configuration, fits within the first end of the glass envelope and is sealed to the glass envelope with an air-tight glass-to-metal seal of substantially cylindrical configuration, a portion of the first metal end piece protruding from the glass envelope in the axial direction;

a second metal end piece which is of substantially cylindrical configuration, fits within the second end of the glass envelope and is sealed to the glass envelope with an air-tight glass-to-metal seal of substantially cylindrical configuration, a portion of the second metal end piece protruding from the glass envelope in the axial direction, the second metal piece further including an integrally constructed end cap larger in diameter than the glass envelope and disposed outside of the glass envelope;

a first leg piece disposed substantially axially within the glass envelope and affixed to the first metal end piece;

a second leg piece disposed substantially axially within the glass envelope and affixed to the second metal end piece;

a filament affixed to the first and second leg pieces, and an annular metal cap larger in diameter than the glass envelope and affixed to the portion of the first metal end piece which protrudes from the glass envelope in the axial direction, the integrally constructed end cap and the annular metal cap acting as surface mountable contacts for electricity for the miniature incandescent lamp whereby electric current flow can be established through the surface mountable contacts and the filament without wires and whereby the miniature lamp is sealed without the use of sealing materials.

14. The lamp assembly of claim 13 where the first and second leg pieces are substantially concentrically disposed with the respective metal end pieces.

15. The lamp assembly of claim 13 wherein the first and second leg pieces consist essentially of nickel.

16. The lamp assembly of claim 13 wherein the first and second leg pieces are affixed to the respective metal end pieces by butt weld joints.

17. A surface mountable miniature incandescent lamp assembly, comprising:

a substantially cylindrical glass envelope having a first end and a second end;

a first metal end piece which is of substantially cylindrical configuration, fits within the first end of the glass envelope and is sealed to the glass envelope with an air-tight glass-to-metal seal of substantially cylindrical configuration, a portion of the first metal end piece protruding from the glass envelope in the axial direction;

a second metal end piece which is of substantially cylindrical configuration, fits within the second end of the glass envelope and is sealed to the glass envelope with an air-tight glass-to-metal seal of substantially cylindrical configuration, a portion of the second metal end piece protruding from the glass envelope in the axial direction;

a first leg piece disposed substantially axially within the glass envelope and affixed to the first metal end piece;

a second leg piece disposed substantially axially within the glass envelope and affixed to the second metal end piece;

a filament affixed to the first and second leg pieces;

a first metal cap of substantially cylindrical symmetry, larger in diameter than the glass envelope and affixed to the portion of the first metal end piece which protrudes from the glass envelope in the axial direction, and a second metal cap of substantially cylindrical symmetry, larger in diameter than the glass envelope and affixed to the portion of the second metal end piece which protrudes from the glass envelope in the axial direction, the first and second metal caps acting as surface mountable contacts for electricity for the miniature incandescent lamp whereby electric current flow can be established through the surface mountable contacts and the filament without wires and whereby the miniature lamp is sealed without the use of sealing materials.

18. The lamp assembly of claim 17 where the first and second metal caps are affixed to the respective metal end pieces by solder joints.

19. The lamp assembly of claim 17 where the first and second metal caps are affixed to the respective metal end pieces by welded joints.

20. The lamp assembly of claim 17 the first and second leg pieces are substantially concentrically disposed with the respective metal end pieces.

* * * * *